US005537701A

United States Patent [19]

Elliott

[11] Patent Number: 5,537,701

[45] Date of Patent: Jul. 23, 1996

[54] ADJUSTABLE ARTICULATED BED

[75] Inventor: Franklin E. Elliott, Culver City, Calif.

[73] Assignee: Maxwell Products, Inc., Cerritos, Calif.

[21] Appl. No.: 213,675

[22] Filed: Mar. 15, 1994

[51] Int. Cl.[6] ..... A61G 7/00

[52] U.S. Cl. ..... 5/617; 5/616; 5/618

[58] Field of Search ..... 5/613, 616, 617, 5/618

[56] References Cited

U.S. PATENT DOCUMENTS

| | | | |
|---|---|---|---|
| 1,658,736 | 2/1928 | Ortmeier . | |
| 2,500,742 | 3/1950 | Taylor | 5/616 |
| 3,220,021 | 11/1965 | Nelson | 5/618 |
| 3,242,507 | 3/1966 | Peterson . | |
| 3,402,408 | 9/1968 | Hutt . | |
| 3,581,320 | 6/1971 | Degen . | |
| 3,593,350 | 7/1971 | Knight | 5/616 |
| 3,644,946 | 2/1972 | Swatt . | |
| 3,686,696 | 8/1972 | Laniyan | 5/618 X |
| 3,693,200 | 9/1972 | Stafford . | |
| 3,793,652 | 2/1974 | Linehan et al. . | |
| 3,898,702 | 8/1975 | Goodman | 5/618 |
| 3,919,727 | 11/1975 | Paine . | |
| 3,965,500 | 6/1976 | Stein, Jr. . | |
| 4,005,497 | 2/1977 | Sutter . | |
| 4,057,240 | 11/1977 | Damico et al. . | |
| 4,095,296 | 6/1978 | Ferro . | |
| 4,218,788 | 8/1980 | Steckmesser . | |
| 4,225,988 | 10/1980 | Cary et al. . | |
| 4,227,269 | 10/1980 | Johnston . | |
| 4,307,477 | 12/1981 | Jacobsen . | |
| 4,336,621 | 6/1982 | Schwartz et al. . | |
| 4,361,917 | 12/1982 | Wilson . | |
| 4,371,996 | 2/1983 | Nahum . | |
| 4,376,316 | 3/1983 | Mercier et al. . | |
| 4,380,838 | 4/1983 | Lutchansky . | |
| 4,381,571 | 5/1983 | Elliott . | |
| 4,385,410 | 5/1983 | Elliott et al. . | |
| 4,407,030 | 10/1983 | Elliott . | |
| 4,494,259 | 1/1985 | Miller et al. . | |
| 4,527,298 | 7/1985 | Moulton . | |
| 4,559,655 | 12/1985 | Peck . | |
| 4,674,140 | 6/1987 | Boonants et al. . | |
| 4,742,586 | 5/1988 | Galumbeck . | |
| 4,839,932 | 6/1989 | Williamson . | |
| 4,893,365 | 1/1990 | Justice . | |
| 4,899,404 | 2/1990 | Glaumbeck . | |
| 4,996,731 | 3/1991 | Kruyt . | |
| 5,129,117 | 7/1992 | Calestira et al. . | |
| 5,160,010 | 11/1992 | Peterson . | |
| 5,165,129 | 11/1992 | Rohm . | |
| 5,195,198 | 3/1993 | Travis . | |
| 5,205,004 | 4/1993 | Hayes et al. . | |
| 5,224,228 | 7/1993 | Larrimore . | |
| 5,245,718 | 9/1993 | Krauska . | |
| 5,315,726 | 5/1994 | Borenstein . | |
| 5,329,657 | 7/1994 | Bartley et al. . | |
| 5,404,604 | 4/1995 | Has et al. | 5/617 |

*Primary Examiner*—Michael F. Trettel
*Attorney, Agent, or Firm*—Poms, Smith, Lande & Rose

[57] ABSTRACT

An adjustable articulated bed including a bed foundation having a body member and a generally separate head member, a mattress supported on the foundation, an electrical motor coupled to the head member, and a support frame which supports the mattress, foundation and motor. The motor when operated pivots the head edge of the head member upwardly, moves the head member away from the body member along a roller-glide assembly, and together with the pivoting motion moves the entire foundation towards the head edge of the frame. Thereby, the head portion of the mattress does not slide with respect to the foundation head member and the head edges of the mattress and foundation travel up in a vertically straight line thereby remaining in constant close proximity to the wall at the head edge of the bed. Advantageously, the person lying on the bed experiences a similar movement; that is, his shoulders move in a straight vertical line. Thus, his head does not move horizontally out of position relative to lamps, radios, telephones or other nearby objects as the head portion of the mattress is moved between its flat and raised positions. Also, his buttocks are not pinched by the crease in the mattress as it folds up. The foundation body member has articulated foot, thigh and seat portions which are adjustable by another electrical motor to configure the upper surface of the body portion of the mattress as desired.

21 Claims, 9 Drawing Sheets

ADJUSTABLE ARTICULATED BED

BACKGROUND OF THE INVENTION

The present invention relates generally to articulated beds having a foundation and a mattress thereon and which are adjustable to provide the desired contoured support to the user lying on the mattress. It more particularly relates to such beds which are driven by one (or more) electrical motor(s) and whose head portion can be pivoted by that motor between a flat orientation and a raised orientation.

Adjustable beds have been used for many years to alter the contours of top surfaces of mattresses to thereby adjust the support on the different portions of the bodies of persons lying on the mattresses. This support adjustment can be for therapeutic purposes, for comfort reasons, or for the user's convenience, as when the user who was previously sleeping now wants to sit propped up to read, eat or watch television. Originally, this adjustment was by manually-operated mechanical levers or cranks. Later, these manually-operated mechanical devices were replaced by one or more motors which drove the adjustable bed into the desired position through gear trains, chain drives, sprocket drives, or threaded shafts.

Adjustable beds are typically used in hospitals or convalescent homes by patients who must spend long periods of time in bed for health, injury or physical handicap reasons. The use of adjustable beds in private homes has increased markedly though in recent years. This is due to the popularity of home television and video viewing, the aging of the population and the technical advances which have been made in the construction, operation and capabilities of adjustable beds.

Examples of adjustable beds known in the prior art are shown in U.S. Pat. Nos. 4,381,571, 4,385,410 and 4,407,030. All of these patents are owned by the present assignee and are hereby incorporated by reference. Additionally, an adjustable bed representative of the prior art is illustrated generally at 50 in FIG. 1 and discussed below.

The conventional adjustable bed 50 has a motor-driven, articulated bed platform plate for supporting and moving equal-length top and foundation mattresses 54, 56. The foundation mattress 56 is usually a cloth-covered foam layer glued to the articulated platform plate, or it can be a box spring similarly attached. When the bed 50 is flat, which is its normal position, the top and foundation mattresses 54, 56 are the same length. When the bed platform shown generally at 57 is operated to cause the mattresses 54, 56 to assume curved shapes, as shown in FIG. 1, the length of the mostly concave top surface of the foundation mattress is noticeably shortened relative to the mostly convex bottom surface of the top mattress. The user's buttocks often are pinched in the crease of the mattress, as shown by reference numeral 58. Also, as the head sections of the mattresses are pivotally raised, an undue amount of compression is placed on the lower mattress 56 at the crease or bend.

The conventional adjustable bed 50 has a footboard or mattress guard 60 to restrain the foot of the top mattress 54 from projecting beyond the foot of the foundation mattress 56. When the bed 50 is curved, the top mattress 54 rides up over the foundation mattress 56 so the head of the top mattress extends beyond the head of the foundation mattress. The top mattress 54 thereby overhangs the bottom foundation 56, as shown generally by reference numeral 62, adversely effecting the wear and comfort features of the head portion of the mattress 54. Also, the frictional sliding of the top mattress 54 over the foundation mattress 56 dissipates energy, increasing the work that must be performed by the motor which adjusts the bed platform plate. In addition when raising the head end of the mattress 54 towards the foot of the bed 50, stationary nearby objects which were originally near the head of the user 64, for example a lamp 66, a radio or a telephone 68 on adjacent night tables or night stands 70, 72, are now behind the user and out of his or her convenient reach.

SUMMARY OF THE INVENTION

Directed to remedying the above-mentioned disadvantages of the prior art, an improved electrically-powered adjustable articulated bed is herein disclosed. The bed includes a foundation having a head section, which supports the head portion of an overlying mattress, and a generally separate body section, which supports the body portion of the mattress. The foundation is supported by and in a stationary frame. A first motor supported by the frame raises and lowers the foundation head section and thereby the mattress head portion. The mattress can be that disclosed in U.S. Pat. No. 4,234,981, for example.

The foundation body section has articulated foot (or lower leg), thigh, and seat (or central) sections, and a second motor moves the foot and thigh sections relative to one another so that the mattress body portion assumes the desired shape for the (lower half of the) user. Particularly, the seat section is fixed horizontal to the foundation frame, the thigh section is pivoted to the seat section and the foot section is pivoted with a hinge to the other end of the thigh section. The second motor when energized lifts this hinge through a torque tube assembly and a pivot arm operated by that assembly. The rear end of the foot section is pivotally connected by a foot support link to the frame. And thus as the rear end moves due to the hinge being lifted, the rear end follows a path of constant distance to the link-frame pivot point.

The first motor is operatively connected to the foundation head section such that when operated it moves the foundation head section simultaneously in three directions—it pivots the head end thereof up with a pivoting force, it moves the head section out the pivot axis with a vector force, and it moves the head section towards the head end of the frame with a reactive force. With these three superimposed movements, the head edge moves with a straight-line vertical movement, maintaining a constant distance from an adjacent parallel wall. In other words, the movement of the head section is a "versed sine" movement. The user lying on the mattress thus does not move horizontally away from lamps, telephones and other adjacent objects. Another way to understand the movement that the user lying on the mattress experiences as the head end of the mattress is raised is the following: the user is pictured wearing sweat clothes and lying on a slick gymnasium floor. His shoulders are grabbed and pulled vertically straight up, he bends at the waist and his entire body including his feet are pulled towards the plane of this vertically straight-up motion.

The foundation head section moves a distance (of about seven inches) further away from the adjacent edge of the foundation body section as the motor moves it. This results in reduced creasing at the juncture of these two surfaces of the corresponding top surface of the mattress supported on the sections. This, in turn, reduces if not eliminates the pinching action previously experienced wherein the buttocks of the user lying on the mattress were pinched by the creasing mattress as the head of the mattress was raised by a conventional adjustable bed (50).

As the motor moves the head section towards the frame head end, it pulls the entire foundation assembly, including the body section and the mattress body portion thereon, towards the wall. This moves the foot end of the foundation a little over twelve inches from a substantial overhang position (of about sixteen or seventeen inches) overhanging the foot support end (the rearmost frame end caster) to a position overhanging the support end by a small distance. There is a risk, albeit small, that the bed (which has an overall length of about eighty inches) could tip over should a severely obese person plop himself down or fall down on the very end of the foundation foot end when in the substantial overhang position. Thus, a support leg or floating bail is provided hanging down from the foot end to engage and drag along the floor or carpet rearward of the rear frame support legs.

The basic lower frame includes four corner posts or legs, casters fitted on each of the legs, a pair of lateral rail tubes and a pair of cross members. Mounted within this basic (rectangular) frame are four horizontal tubular glide rails, parallel to the lateral rail tubes and forming a trackway. The motorized foundation assembly (or the "pivotal glide" or the "upper carriage") is supported on this trackway such that it can transverse longitudinally on the trackway and within the lower frame. This longitudinal movement results when the foundation head (or back) section is inclined and declined.

Pivotal links connect to the head end of the frame at one link end and to brackets secured to the underneath of the head section at the other link end. Thus, as the head section is pivoted up these (fixed length) links cause the motorized foundation assembly to transverse within the lower frame and the extreme head end of the mattress to move only in a fixed vertical plane. The first and second motors can be operated by a pendant-type or wireless controller placed on a night stand adjacent to the head end of the bed. The user has easy access to the controller due to the combined pivotal and transverse movements of the head section of the bed. The multiconductor electrical pendant cord may have a small diameter especially if low voltages are used to activate switching of high voltages in a controller located under the bed. Infra-red or radio frequency types of controllers may be used when it is desired to eliminate the direct wiring and/or when the controller is to perform other functions such as switching the lights or operating television, radio or video cassette recorders. A massage motor can also be incorporated into this bed as would be apparent to those skilled in the art.

Other objects and advantages of the present invention will become more apparent to those persons having ordinary skill in the art to which the present invention pertains from the foregoing description taken in conjunction with the accompanying drawings.

DETAILED DESCRIPTION OF THE INVENTION

Figure 4:
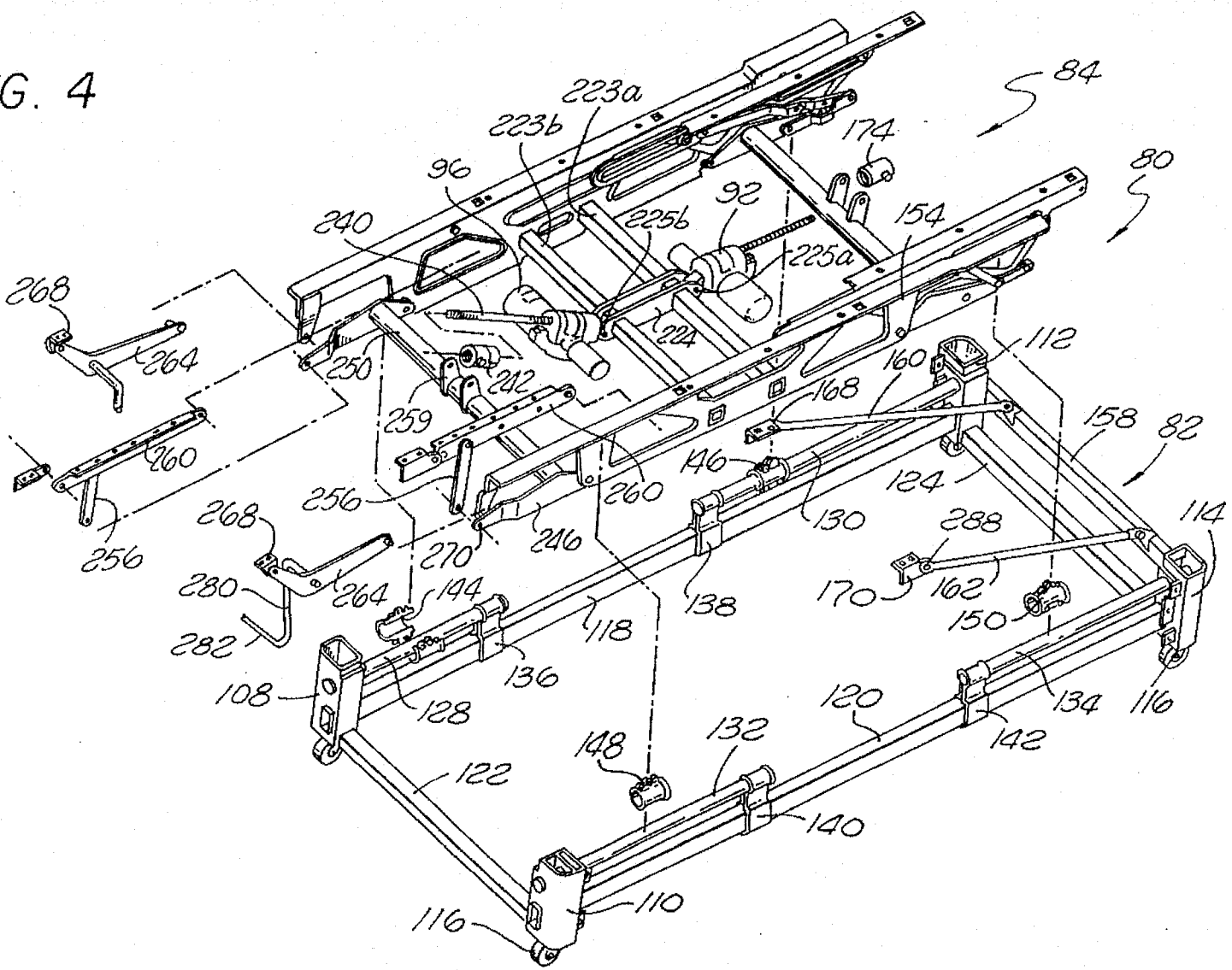
FIG. 4 is an exploded perspective view of the bed of FIG. 2.

Referring to the drawings, a preferred articulated adjustable bed embodiment of the present invention will now be described in detail. An articulated adjustable bed of the present invention is shown in the drawings generally at 80. Referring to FIG. 4 for example, bed 80 is seen to comprise a lower support frame shown generally at 82 and a motorized foundation assembly (or a "platform glide" or an "upper carriage") shown generally at 84 and positionable in the support frame. The foundation assembly 84 includes a two-part foundation at the top thereof. One part is a head foundation section or part 86 having a length of approximately 30.5 inches and the other part is a body foundation section or part 88 having a length of approximately 49.25 inches. The body foundation part 88 is articulated as will be described later and as is apparent from FIG. 11, for example. The foundation parts can be mattress foundations or box spring (either coil or "kinky" spring) types of foundations. The foundation parts 86, 88 can each be constructed, for example, of a plywood base, a polyfoam layer glued to the plywood and a cover over them and filled with a fill material.

The foundation parts 86, 88 in turn support a mattress 90 such as is used on conventional prior art articulated beds and including that disclosed in U.S. Pat. No. 4,234,981. This mattress 90 can have hinges therein to hingedly couple the different parts or sections together. The mattress 90 need not be secured to the foundation parts 86, 88 but can simply rest on top of them. If desired, straps at the foot end mattress corners can be used.

The motorized foundation assembly 84 includes a first motor 92 which lowers and raises the foundation head section 86 and, as will be described later, pulls the entire motorized foundation assembly within the frame 82 and towards the head end 94 of the frame. A second motor 96 when operated controls the articulation of the body section 88 and thereby the body portion 98 of the mattress 90 as can be seen by comparing the left halves of FIGS. 10 and 11. These motors 92, 96 can be operated by a remote control such as previously described.

Figure 1:
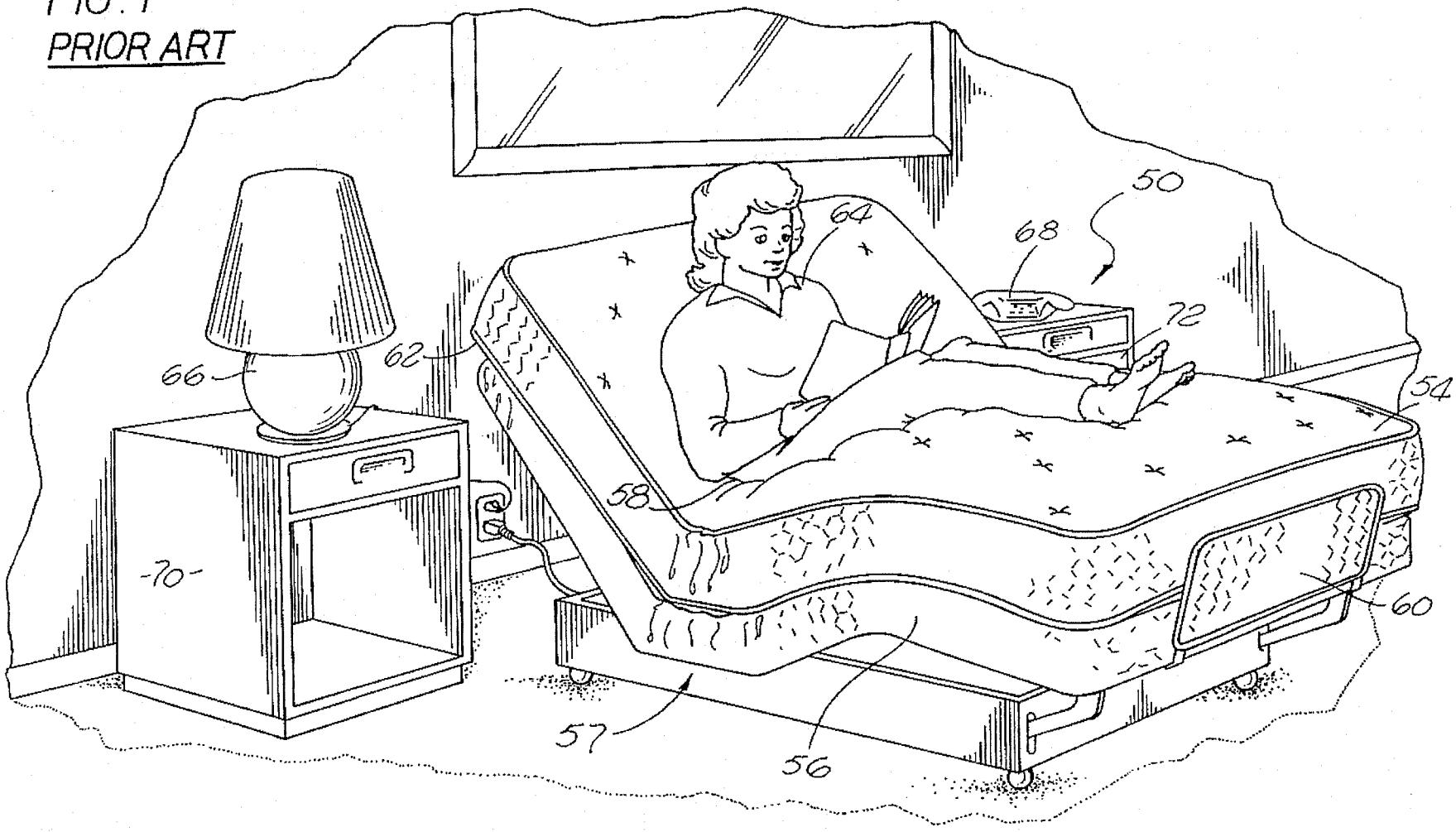
FIG. 1 PRIOR ART
FIG. 1 is a perspective view of an adjustable articulated bed of the prior art, shown in use (but without blankets and bed sheets for illustrative purposes)
Figure 2:
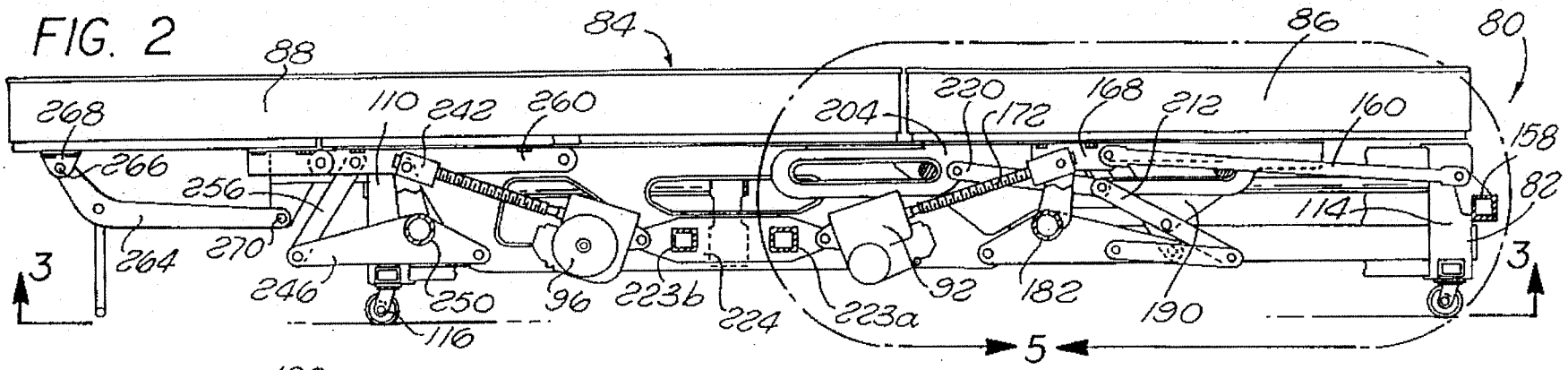
FIG. 2 is a side elevational view of an adjustable articulated bed of the present invention, shown without a mattress and in a flat orientation.
Figure 9:
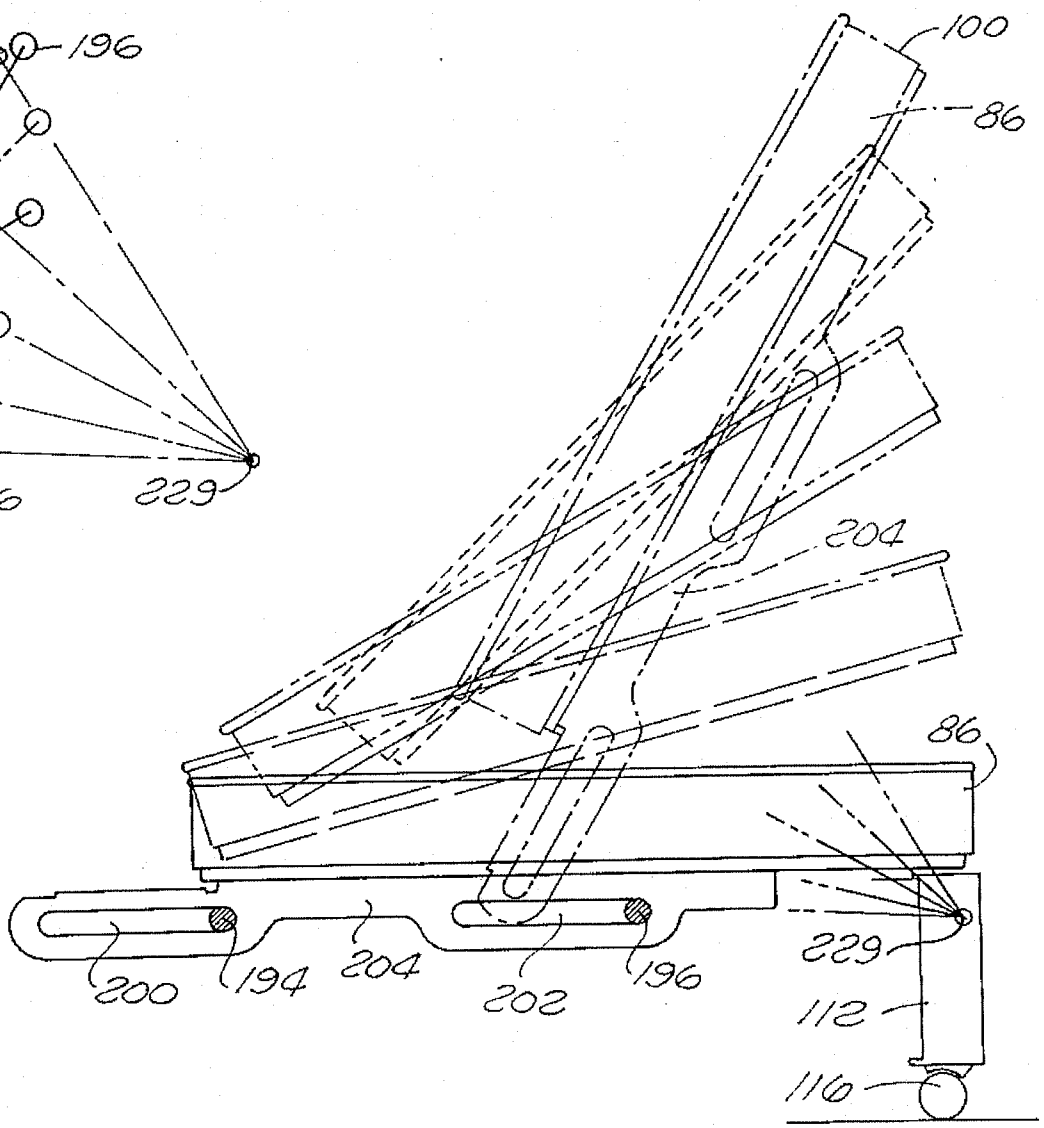
FIG. 9 is a schematic representation showing the movement of the head section between its level and fully raised positions.

With the operation of the first motor 92 the foundation head section 86 is caused to have three simultaneous movements, as can be perhaps best understood by looking at FIG. 9. The first movement is the upward pivoting of the foundation head section 86 to a maximum of sixty degrees, the second is a vector motion out along the pivot axis of approximately seven inches and the third motion moves the foundation head section horizontally forward about twelve and five-eights' inches towards the end 94 of the frame 82, that is, towards an adjacent wall (see FIG. 1) at the head end of the frame. These three motions when combined result in the movement as shown by the dotted lines in FIGS. 9 and 10. This resulting movement causes the forwardmost edge 100 of the foundation head section 86 and thus the head edge 102 of mattress 90 to move vertically varying only by a horizontal inch in a straight line; that is, the head portion of the mattress moves with a "versed sine" motion. The head edges 100, 102 of the foundation head section 86 and of the mattress 90 remain aligned as can be seen in the upper right corners of FIGS. 10 and 11, and unlike the prior art as shown at 62 in FIG. 1. Additionally and referring to FIG. 10, the shoulders 104 of the user 106 lying on the mattress 90 remain in (substantially) the same vertical plane when in the lower flat position and when in the raised position as can be understood from FIG. 10. Lamps, phones, clocks, bed controls and other nearby objects (see FIG. 1) are still conveniently positioned and oriented for the user. He does not need to reach back behind him to access them.

Figure 10:
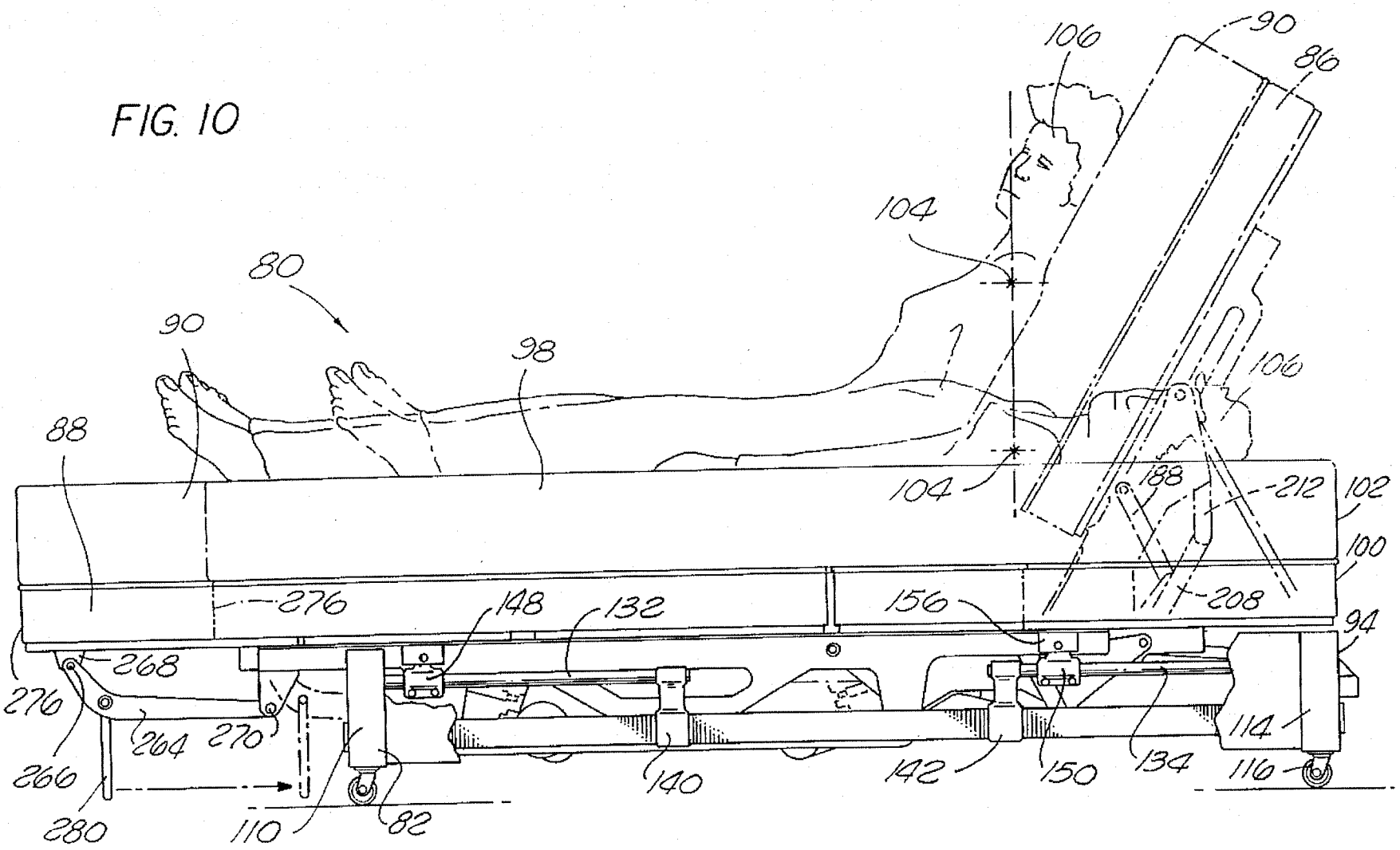
FIG. 10 is a view similar to that of FIG. 2, showing a mattress in position thereon, a person lying on the mattress and (in dotted lines) the head section of the bed in a fully pivoted position.

Referring to FIG. 4, frame 82 includes four corner posts 108, 110, 112, 114 with casters 116 fitted to the bottoms of each of them, snap fit into post bottom sockets. A pair of longitudinal rails 118, 120 and a pair of lateral rails 122, 124 connect the posts 108, 110, 112, 114 into a rectangle. Four rail guide members 128, 130, 132, 134 are each connected at their ends to respective corner posts 108, 110, 112, 114 by passing (or floating) through post holes with a tenon and mortise fit. They extend inwardly and longitudinally above the side rails 122, 124 and are held at their inner ends by respective brackets 136, 138, 140, 142 secured above to the longitudinal rails by welding thereto. Four coupler sleeves (or clam shell bushings or linear bearings) 144, 146, 148, 150 encircle respective ones of these rail guide members 128, 130, 132, 134 and are secured to the frame 154 of the motorized foundation assembly 84 by connecting brackets 156, such as shown in FIG. 10, having a pin attachment and rocking capabilities to account for deflection. Thus, when the motor 92 is powered the motorized foundation assembly 84 slides longitudinally along the rail guide members 128, 130, 132, 134. The couplers can be constructed as upper and lower rollers, which can have curved engagement surfaces, instead of the bushings.

Figure 11:
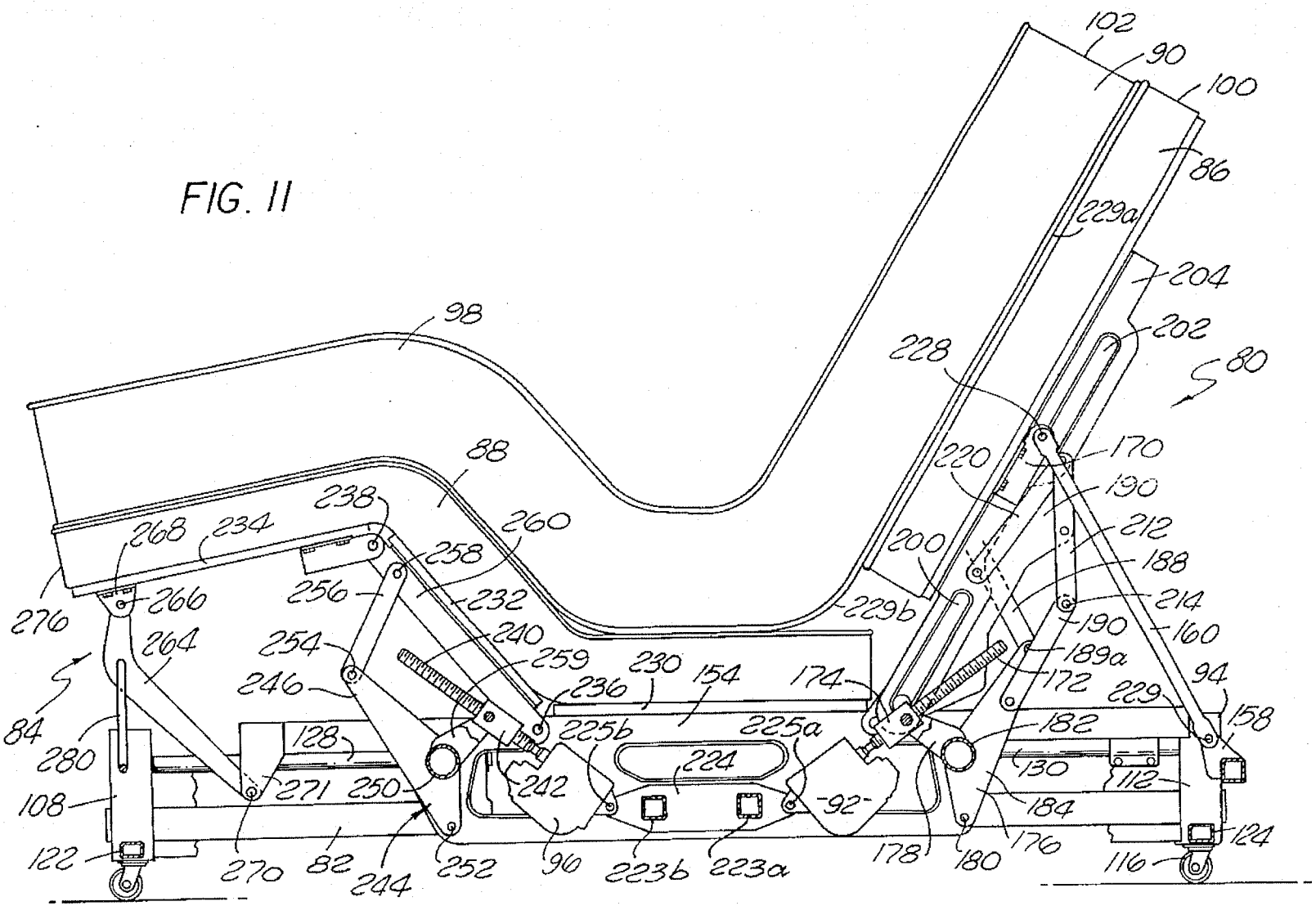
FIG. 11 is a view of the bed and mattress similar to that of FIG. 12, but without a person lying thereon and with the foot and thigh sections thereof in the fully elevated positions and the head portion in the fully pivoted position.

A lateral support tube 158 is secured to the two corner posts 112, 114 and extends between them at the head end 94 of the frame. Drag links 160, 162 are pivotally secured by respective brackets 164, 166 at lower ends thereof to that tube 158. At their upper ends these two drag links 160, 162 are pivotally secured to respective brackets 168, 170 which are mounted to the bottom of the foundation head section 86. The flattened tube drag links 160, 162 cause the entire motorized foundation assembly 84 to move longitudinally towards the head 94 of the frame 82 as the foundation head section 86 is lifted. Drag links 160, 162 push the bed with respect to the frame as the head section is lowered, and they prevent the bed from being pulled back and forth. They keep the brackets 168, 170 at a fixed distance from the tube 158 at the head end 94 of the frame, as the head section is lifted and lowered. Springs can be provided on forward rail guide members 130, 134 to prevent locking when drag links 160, 162 are in their fully raised positions as shown in FIGS. 8 and 11.

Figure 5:
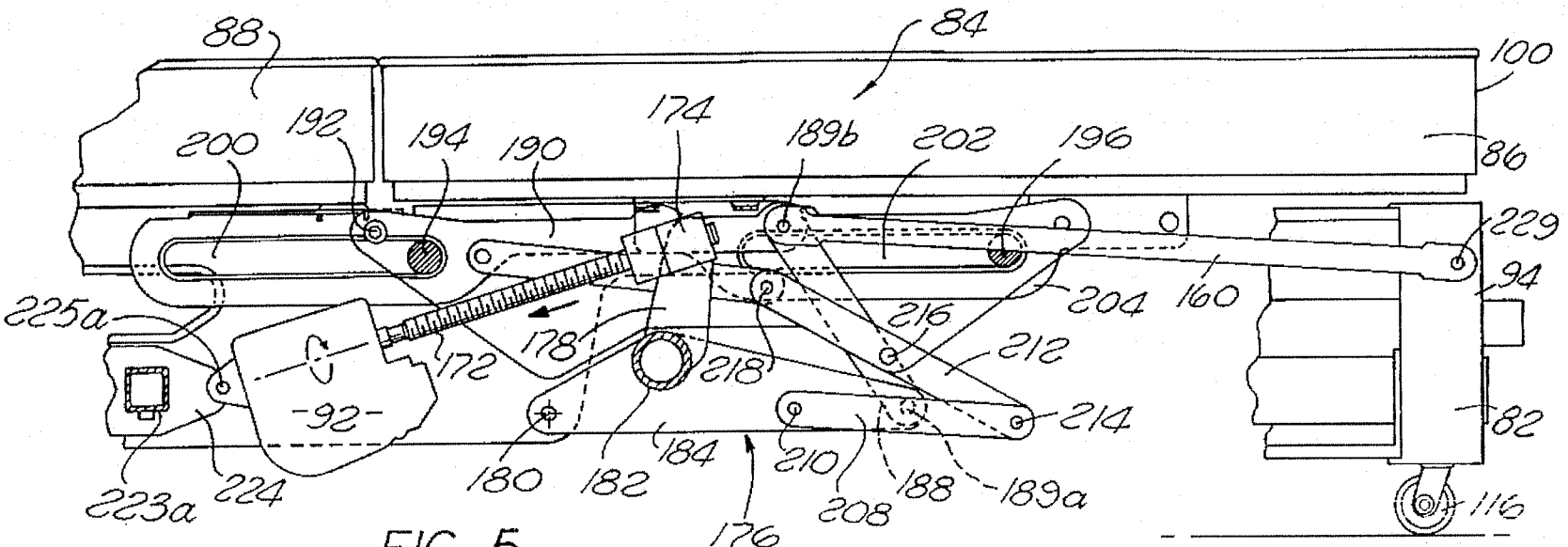
FIG. 5 is an enlarged view taken on circle 5 of FIG. 2.
Figure 6:
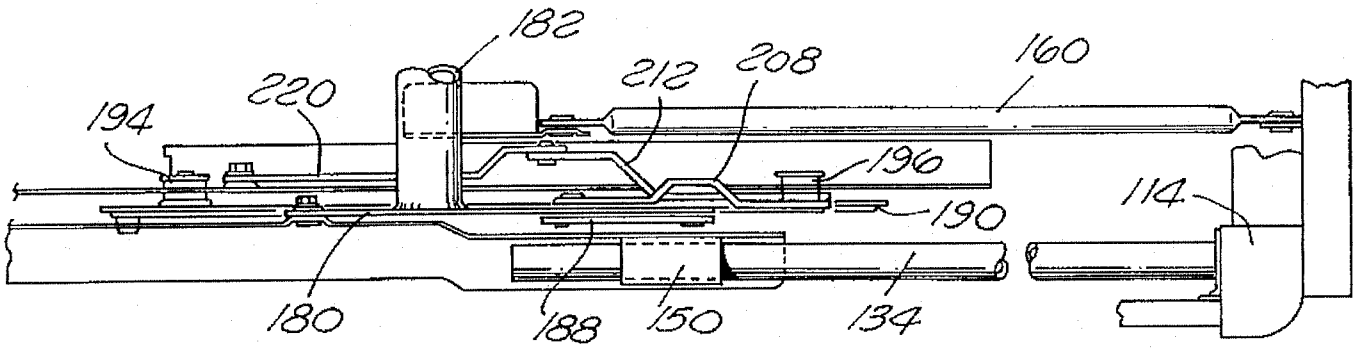
FIG. 6 is an enlarged view taken on circle 6 of FIG. 3.
Figure 7:
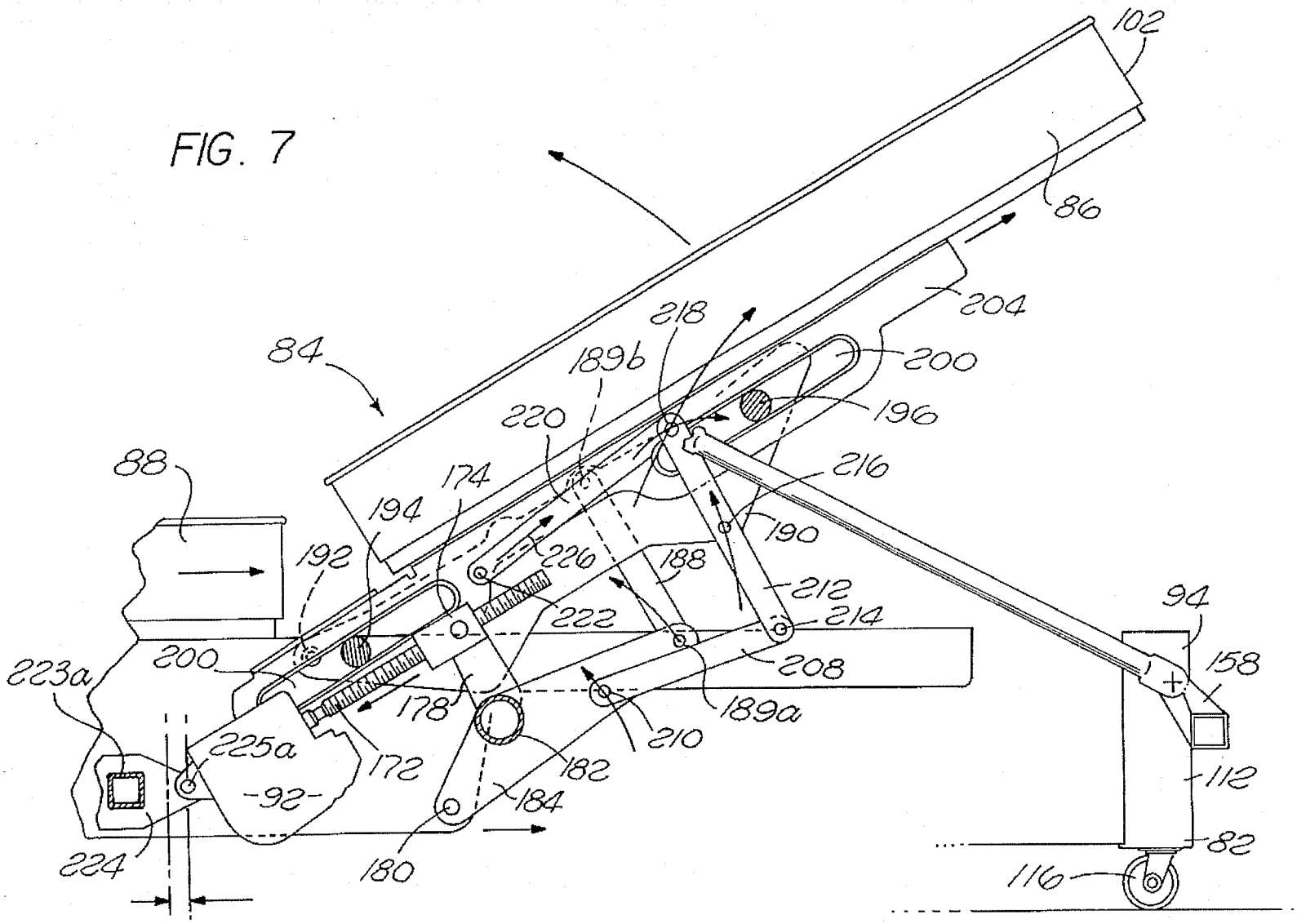
FIG. 7 is a view similar to FIG. 5, showing the head section in a partially raised position.
Figure 8:
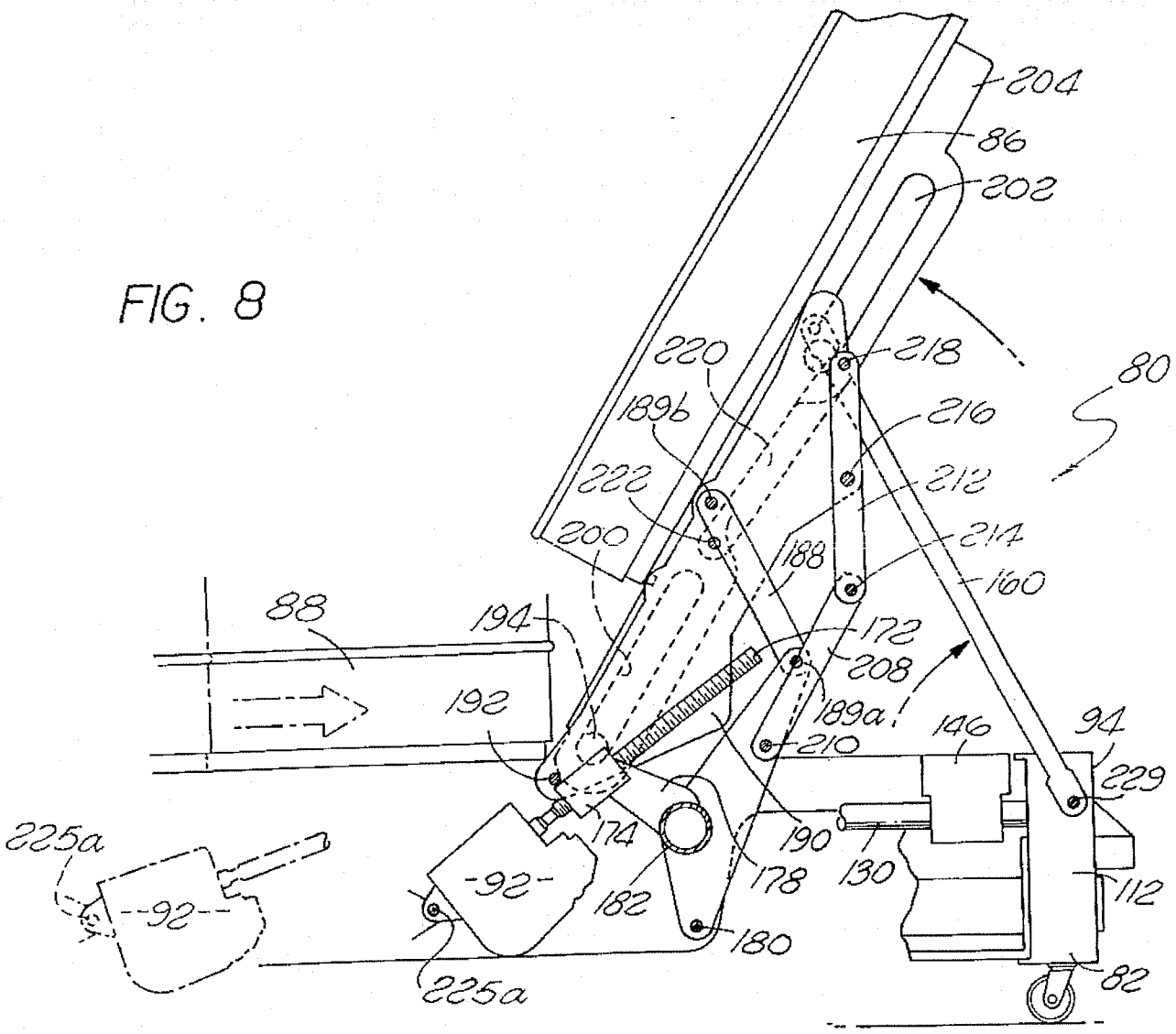
FIG. 8 is a view similar to FIG. 7, showing the head section in a fully raised position.

The pivotal or lifting movement of the foundation head section 86 can be understood, for example, by comparing FIGS. 5, 7 and 8 which show the raising of the head section and the linkage for doing such. Referring thereto it is seen that as the motor 92 operates through a drive gear the drive shaft 172 is rotated. This rotation causes a nut 174 secured with pivot pins on the shaft 172 to be moved along the shaft. A torque tube assembly shown generally at 176 is secured by a connector arm 178 to the nut 174, and as the nut is driven along the shaft 172 it causes the torque tube assembly to pivot about a pivot point 180 on the frame 154. The arm 178 is firmly secured to the cross bar or tube 182 of the torque tube assembly 176 using a "spanner wrench" type of securement together with welding. The torque tube assembly 176 includes a triangular bell crank 184 with one corner of the triangle corresponding to the pivot point 180, another corner including the transverse torque tube 182 to which the connector arm 178 is secured and a third corner. A lifting link 188 at one end thereof is pivotally secured at point **189*a* to that third corner and the other end of the link is pivotally secured at point 189*b* to a primary hinge 190. The primary hinge 190, in turn, is pivotally connected at end point 192 to the foundation frame 154. Thus, point 189*b* travels in an arc about point 192 and point 189*a* travels in an arc about point 180**.

Primary hinge 190 has a pair of spaced rollers 194, 196 extending out from it. These rollers 194, 196 ride in elongated slots 200, 202 formed in a secondary hinge 204. The secondary hinge 204 is fixed to the underneath of the foundation head section 86. The rollers 194, 196 are a bit smaller diameter than their respective slots 200, 202 so they do not contact simultaneously the tops and bottoms of the slots. This reduces the possibility of the rollers 194, 196 binding up due to minor twisting or misalignments of the two hinges 190, 204.

A second link 208 is pivotally connected to an intermediate bell crank point 210 at one end thereof and at the other end thereof it is secured to a pendulum or rocker link 212 at point 214. The rocker link 212 is pivotally connected at its center 216 to the hinge 190 and at its opposite end 218 to another link 220, which is pivotally secured at its opposite end 222 to the secondary hinge 204.

A pair of tubular lateral support members **223*a*, 223*b* extend spaced and parallel across a central portion of the foundation frame 154. Each has a square cross section fitting into corresponding square apertures in the foundation frame 154. Mounted midway on the members 223*a*, 223*b* are a pair of motor mounting plates 224. The motors 92, 96 are pivotally mounted at opposite ends of the plates and on opposite sides of the members at pivot points 225*a*, 225*b*, respectively. Pivot points 225*a*, 225*b* provide pivot, thrust and anchor points for the respective motors 92, 96. This mounting and support of the motors is similar to the arrangement described in the U.S. Pat. No. 4,407,030. One important difference is that two (spaced) support members 223*a*, 223*b***, instead of a single support member, are used. This provides for more user seat room on the bed and thus less pinching.

Thus, the motor 92 turns a worm gear which engages a bull or spur gear which turns the shaft 172. Pivot screws cause the turning shaft 172 to move the nut 174 along the shaft. As the nut 174 travels down the shaft 172 and the torque tube assembly 176 is rotated via connector arm 178 about point 180, the lifting link 188 is similarly rotated as shown by the arrows in FIG. 7, for example, exerting a pivoting force through point **189*b* on the hinge 190. As the nut 174 is pulled down the shaft the motor 92 exerts a thrust or pulling force on frame 154 through pivot point 225***a*. The motor 92 also pivots about that point. The rocker link 212 is then pivoted in a clockwise direction, by link 208, pulling on link 220, thereby pulling the secondary hinge 204 with a vector force out the pivot axis. That is, as the rocker link 212 is rotated clockwise at point 216 which is attached to the primary hinge 190, the other end of the link is pivoted about a (free link pivot) point 218 which is attached to link 220. Thus, as link 212 rotates about pivot point 216 in a clockwise direction it pulls the link 220 in the direction shown by the arrow 226 in FIG. 7. Link 220 is attached to the secondary hinge 204.

Figure 9A:
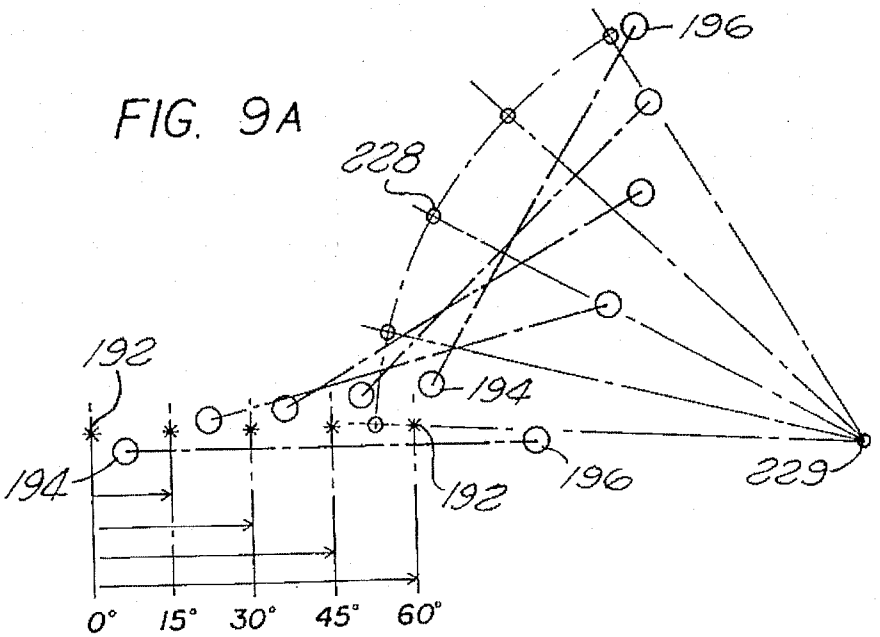
FIG. 9A is a view similar to FIG. 9, showing the rollers, the primary hinge pivot point and the support member pivot points in the 0, 15, 30, 45 and 60 degree pivot positions of the head section.

Thus, as the bell crank 184 is rotated, the pendulum or rocker link 212 is rotated clockwise away from the foot of the bed thereby pulling link 220 which pulls the secondary hinge 204. The secondary hinge 204, as it is being pulled towards the right as seen in the drawings, rides on the rollers 194, 196 within the slots 200, 204. See, for example, FIG. 9A. The secondary hinge 204 moves relative to the primary hinge 190 by this roller-slot relationship. As the primary hinge 190 is rotating about sixty degrees it is being pulled along with the rest of the motorized frame assembly 84 on the sleeves (or bushings or linear bearings) 144, 146, 148, 150 due to the reactive force through support member(s) or link(s) 160 (and 162). The motions of the rollers 194, 196, the pivot point connection 192 of the primary hinge 190 to the assembly frame 154, the pivotal connection 228 of the drag links 164, 166 to the back of the frame head section 86 and the pivotal connections 229 of the members 164, 166 to the tube 158 are shown in FIG. 9A. The positions of each of these elements are shown therein at zero, fifteen, thirty, forty-five and sixty degree orientations of the head section 86. As can be seen, roller 194 moves in a small arc and roller 196 moves in a larger arc.

Thus, the lifting force through lifting link 188, the vector force through link 220 and the reactive force through members 160, 162 move the head section 86 with a "slithering" movement between its horizontal flat position and its pivotally raised position. The vector power or ejecting force is off of point 210. The forward edges 100, 102 of the mattress and head section travel vertically up and down.

The relationships and movements of the components were also chosen to minimize pinching of the user's buttocks in the crease of the mattress 90 as it is pivoted up. Particularly, and referring to FIG. 11, the top surface 229*a* of the head section 86 throughout its entire movement is always tangent to the curve 229*b* of the mattress 90. In other words, the top surface 229*a* moves a distance sufficient to maintain a tangency to the curve 229*b* being generated by the flexing of the mattress 90 at the buttocks or tail bone of the user.

As best seen in FIG. 11, the foundation body section 88 includes three articulated sections, namely, a seat or center section 230, a thigh section 232, and a lower leg or foot section 234. Each of these sections is articulated relative to the adjacent section or sections. The seat section 230 is fixed to the foundation frame 154, the thigh section 232 is pivotal relative to the seat section 230 about point 236, and the foot section 234 is pivotal about point 238 and movable relative to both of the sections. The mechanism for controllably moving or adjusting the thigh and/or foot sections 232, 234 is similar to that illustrated in the U.S. Pat. No. 4,407,030 and reference is hereby again made to that patent. The mechanism is operated by the operation of the motor 96. The motor 96 has a gear train which drives a threaded shaft 240, which passes through a threaded, low friction bushing or nut 242, which is connected thereto with pivot screws. A torque tube assembly 244 is provided, similar to the one at the forward end of this bed. It includes a triangular plate or bell crank 246 secured at one corner to one end of the cross bar member 250 (another bell crank plate is secured at the other bar member end as seen in FIG. 4 for example), at a second corner pivotally to the foundation frame 154 at point 252, and at its third corner pivotally at point 254 to a lifter link or a pivot arm 256. Lifter link 256 is pivotally attached at its opposite end at point 258 to a longitudinal support member 260 secured to the thigh section 232.

Thus, as the motor 96 is energized and the nut 242 is caused to travel along the shaft 240 towards the motor, the bell crank 246 through connector arm 259 pivots about pivot point 252 in a clockwise direction. This in turn pivots the lifter link 256 upwardly against the support member or thigh hinge 260 thereby lifting the thigh section 232, as shown in FIG. 11. As the motor 96 pulls on the nut 242 it exerts a force on frame 154 through pivot point 225*b* and also pivots about that point.

A pair of J-shaped pivotal linkages or foot support links 264 are provided at the foot end of the bed. Linkage 264 is pivotally coupled at point 266 to a hinge 268 secured to the bottom of the foot section 234 of the foundation, and at its opposite end it is pivotally connected at point 270 to a bracket 271 which in turn is secured to the frame 154. Thus, as the thigh section 232 is lifted by the lifter link 256, the forward end of the foot section 234, which is articulated to the rear end of the thigh section 232, is lifted. The rearward or foot end of the foot section 234 is also lifted. And its movement is controlled by the foot support link 264, which maintains a constant distance between the two pivot ends of that link, that is, between the pivotal connection to the frame brackets 271 which is secured to these frame 154 and the lower pivotal connection to the foot section.

As previously described, the entire motorized foundation assembly 84 moves longitudinally with respect to the lower foundation frame 82 as the foundation head section 86 is pivoted upwardly and downwardly. Thus, the foot edge or end 276 of the motorized foundation assembly moves as well and with respect to the rearmost posts or legs 108, 110 of the frame 82. Referring to FIG. 10, the rear edge 276 of the foundation assembly, when the head section 86 is in its fully raised position, is shown with dotted lines. And it extends beyond or overhangs the rear posts 108, 110. This overhang or underneath space is desirable to reduce the likelihood that people will accidently stub their toes or otherwise hit their feet against the rear posts 108, 110 or casters 116. When the head section 86 is lowered to its flat position, the foot edge 276 of the foundation extends even a further overhang distance out beyond the rear posts 108, 110. This distance is enough that in the unlikely event that a severely obese person would plop himself down or fall down on the overhang foundation portion the entire bed 80 could be tilted up and about the rear posts 108, 110 or rear casters 116. Accordingly, a rear leg or floating bail 280 extending down from the foot support links 264 is provided. As the foundation assembly 84 is moved in the frame 82, the lower end member 282 of this bail 280 simply rides or drags along the floor or carpet. In the event of this "toppling" force the bail 280 contacts the floor thereby preventing tipping of the bed.

Figure 3:
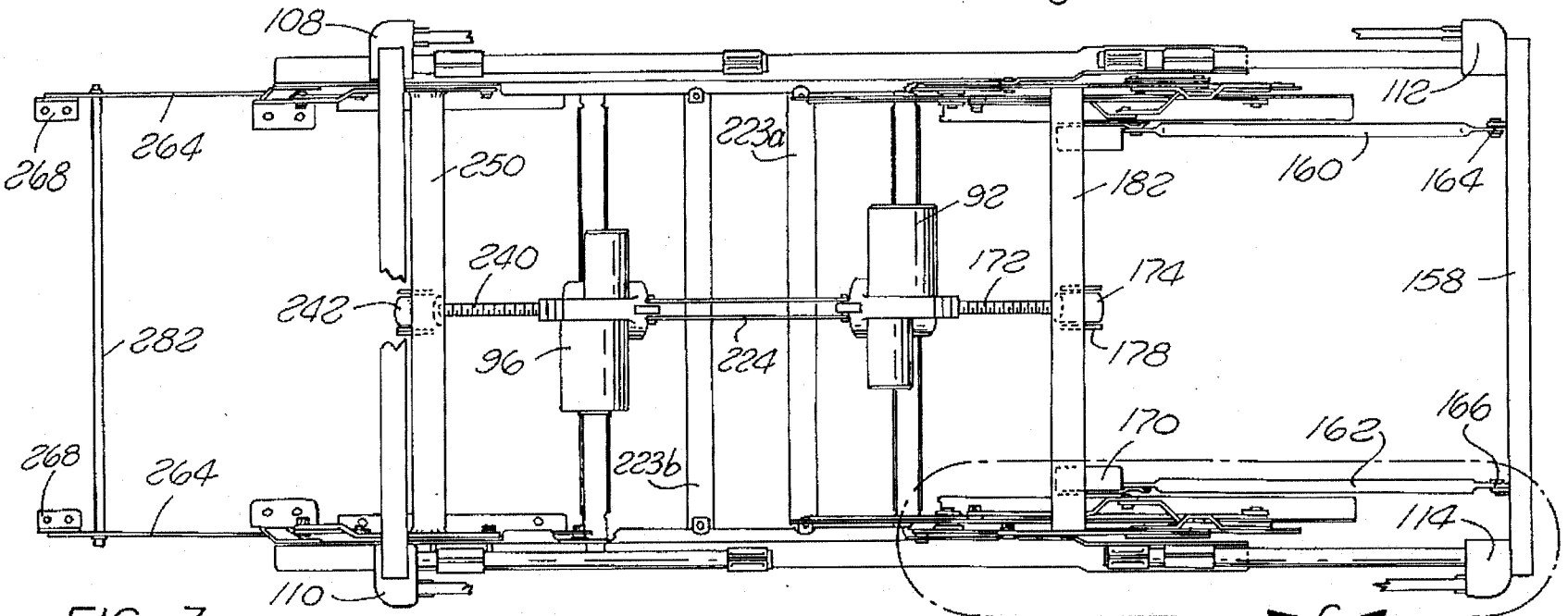
FIG. 3 is a bottom view taken on line 3—3 of FIG. 2 and with certain portions of the foundation omitted for illustrative purposes.

Bail 280 is formed as a U-shaped member as can be understood from FIG. 3, for example, and is pivotally attached to its opposite end to the foot support links 264. A slot or similar attachment can be provided to prevent pivoting or locking of the bail 280 from the "toppling" force. It is out of the way of the corner posts 108, 110 though when the foot section 234 is raised, as shown in FIG. 11. Instead of the bail 280 the foot support links 264 themselves can be reconfigured from their J-shapes to a V-shape and the point of the V can extend down a distance to perform the anti-toppling support function.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. An adjustable bed, comprising:

a bed frame having a frame head end and an opposite frame foot end;

a foundation body assembly supported at least in part by said frame to support a head portion of a mattress;

a foundation head assembly generally separate from said foundation body assembly and supported at least in part by said frame to support a body portion of the mattress; and moving means for moving said foundation head assembly from a generally horizontal position up and away from said foundation body assembly and to a pivoted raised position.

2. The bed of claim 1 wherein said moving means moves both said foundation head assembly and said foundation body assembly relative to said frame and towards said frame head end.

3. The bed of claim 1 further comprising means pivotally coupled to said foundation head assembly for guiding the movement of said foundation head assembly between the horizontal position and the raised position.

4. An adjustable bed, comprising:

a bed frame having a frame head end, a frame foot end and a rearmost frame support member at said frame foot end and supported by a lower support surface;

a bed foundation supported by said frame and having a foundation foot end portion;

a bed mattress supported on said foundation and having a mattress foot end portion supported on said foundation foot end portion;

wherein said foundation is movable relative to said frame between a first position wherein said foundation foot end overhangs said frame support member by a substantial distance and a second position wherein said foundation foot end is closer to said frame head end and overhangs said frame support member by a distance substantially less than the substantial distance; and a foundation support member secured to said foundation foot end and movable therewith between the first and second positions and depending down therefrom to engage the lower support surface to thereby prevent tipping of said foundation over said frame support member when a significant downward force is exerted on an overhanging portion of said foundation foot end portion with said foundation foot end portion in the first position.

5. The bed of claim 4 wherein said foundation support member is rearward of said frame support member when said foundation is in the second position.

6. The bed of claim 4 wherein said frame support member includes a frame leg and a caster at the lower end thereof to ride on the lower support surface.

7. The bed of claim 4 further comprising an electrical motor supported by said frame and coupled to said foundation to controllably move said foundation between the first and second positions.

8. A method of adjusting the position of a bed, comprising the steps of:

providing a motorized assembly supported by a bed frame, the assembly having a base assembly portion and a back assembly portion;

providing a mattress foundation having a base foundation portion secured to the base assembly portion and a back foundation portion secured to the back assembly portion; and moving the back assembly portion, and thereby the back foundation portion, generally about a pivot point from a generally horizontal orientation to a pivotally raised orientation and radially away from the pivot point as the back assembly portion moves to the raised orientation.

9. An adjustable bed, comprising:

a bed frame having a frame head end and a frame foot end;

a foundation head assembly supported at least in part by said frame for supporting a head portion of a mattress, said foundation head assembly having an assembly head end;

a foundation body assembly supported at least in part by said frame for supporting a body portion of the mattress; and motor means for pivoting said foundation head assembly end from a generally horizontal position to a pivoted raised position and, as said assembly head end is being pivoted up, for moving said foundation head assembly and said foundation body assembly relative to said frame and towards said frame head end;

wherein said motor means moves said foundation head assembly away from said foundation body assembly.

10. The bed of claim 9 further comprising means for roller gliding said foundation head assembly between the horizontal and the pivoted raised positions.

11. The bed of claim 9 wherein said foundation body assembly includes articulated leg, thigh and seat sections supporting respective portions of the mattress.

12. The bed of claim 11 further comprising motorized means for moving said thigh section relative to said seat section.

13. The bed of claim 12 wherein said motorized means includes an electrical motor pivotally coupled to said foundation body assembly.

14. An adjustable bed, comprising:

a bed frame having a frame head end and a frame foot end;

a foundation head assembly supported at least in part by said frame for supporting a head portion of a mattress, said foundation head assembly having an assembly head end;

a foundation body assembly supported at least in part by said frame for supporting a body portion of the mattress; and motor means for pivoting said foundation head assembly end from a generally horizontal position to a pivoted raised position and, as said assembly head end is being pivoted up, for moving said foundation head assembly and said foundation body assembly relative to said frame and towards said frame head end;

wherein said motor means includes a first hinge pivotally coupled to said foundation body assembly, a second hinge affixed to said foundation head assembly, a motor assembly, a bell crank pivotable about an axis of said foundation body assembly by the operation of said motor assembly, first linkage means for coupling said bell crank to said first hinge so that as said bell crank is pivoted said foundation head assembly is lifted, second linkage means for coupling said bell crank to said second hinge so that as said bell crank is pivoted said second hinge is moved along said first hinge, and a support member pivotally connecting said foundation head member to a lateral axis at the head of said frame.

15. The bed of claim 14 wherein said motor assembly includes a motor pivotally connected to said foundation body assembly and movable therewith, a shaft rotatably driven by said motor, a member driven along said shaft by the rotation of said shaft, and connecting means for connecting said member to said bell crank such that as said member is driven along said shaft said bell crank is pivoted.

16. The bed of claim 14 wherein said motor means further includes roller guide means for guiding the movement of said second hinge along said first hinge.

17. The bed of claim 14 wherein said motor means moves said foundation head assembly away from said foundation body assembly.

18. The bed of claim 17 further comprising means for roller gliding said foundation head assembly between the horizontal and the pivoted raised positions.

19. The bed of claim 14 wherein said foundation body assembly includes articulated leg, thigh and seat sections supporting respective portions of the mattress.

20. The bed of claim 19 further comprising motorized means for moving said thigh section relative to said seat section.

21. The bed of claim 20 wherein said motorized means includes an electrical motor pivotally coupled to said foundation body assembly.

* * * * *